United States Patent [19]

Stein

[11] 4,050,825

[45] Sept. 27, 1977

[54] CAKE OF SOAP, ESPECIALLY FOR WASHING HANDS

[76] Inventor: Walter Stein, 18 Hauptstrasse, D-7707 Engen, Germany

[21] Appl. No.: 420,972

[22] Filed: Dec. 3, 1973

[51] Int. Cl.[2] ..... A46B 15/00; C11D 17/04

[52] U.S. Cl. ..... 401/19; 15/106

[58] Field of Search ..... 401/19; 128/62 R

[56] References Cited

U.S. PATENT DOCUMENTS

| | | | |
|---|---|---|---|
| 419,275 | 1/1890 | Mitchell | 401/19 |
| 488,393 | 12/1892 | Jewett | 401/19 |
| 816,002 | 3/1906 | Burt | 401/19 |
| 1,954,940 | 4/1934 | Mikel | 128/62 R X |
| 2,007,107 | 7/1935 | Bottril | 128/62 R X |
| 2,131,500 | 9/1938 | Curtis | 401/19 |
| 2,669,738 | 2/1954 | Kusznir | 401/19 |
| 2,979,748 | 4/1961 | Beatty | 401/19 |

FOREIGN PATENT DOCUMENTS

| | | | |
|---|---|---|---|
| 1,074,798 | 2/1960 | Germany | 401/19 |
| 495,501 | 7/1954 | Italy | 401/19 |

*Primary Examiner*—Stephen C. Pellegrino

*Attorney, Agent, or Firm*—Diller, Brown, Ramik & Wight

[57] ABSTRACT

An article for cleansing including a cake of soap defined in part by a top surface and opposite end surfaces with a recess opening upwardly through the top surface and endwise through the end surfaces with the opening being defined by a bottom surface and opposing spaced inner peripheral surfaces, a plate in the recess completely covering the bottom surface and having means for preventing water from erroding the peripheral surfaces thereby precluding disintegration of the cake of soap, the errosion preventing means being defined by an upper surface of the plate opening concavely outwardly in a direction toward the top surface and/or by a pair of flanges carried by the plate directed from the plate upper surface toward the top surface with each flange being contiguous an associated one of the cake soap peripheral surfaces.

13 Claims, 18 Drawing Figures

CAKE OF SOAP, ESPECIALLY FOR WASHING HANDS

The invention relates to a cake of soap, more especially for use in washing hands. Such cakes of soap are usually formed in a square or circular shape and the soap may have an abrasive material or chemicals added thereto to increase the cleaning effect of the soap. For certain types of contamination and for certain intended uses such additives however, are inadequate or unsuitable. In these cases —such as for cleaning fingernails — scrubbing with a nailbrush of a conventional kind is usual.

The object of the present invention is to provide a cake of soap without abrasive or chemical additives that has an adequate cleaning effect, and cleans the fingernails without leaving traces of soap therein.

According to the present invention there is provided a cake of soap including at least one plate firmly embedded therein and provided at least on one of its surfaces with bristles, the soap being recessed to receive the plate.

Figure 2:
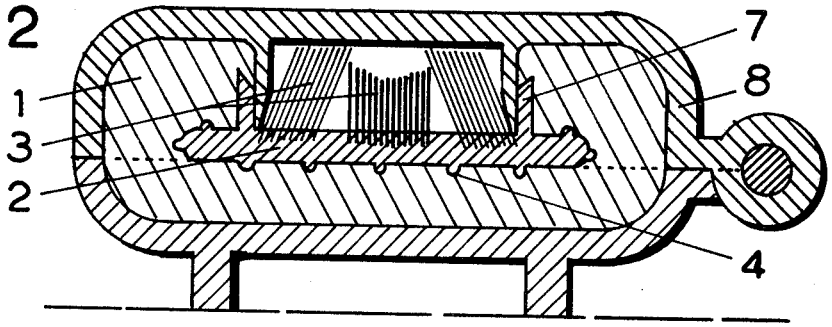
Figure 3:
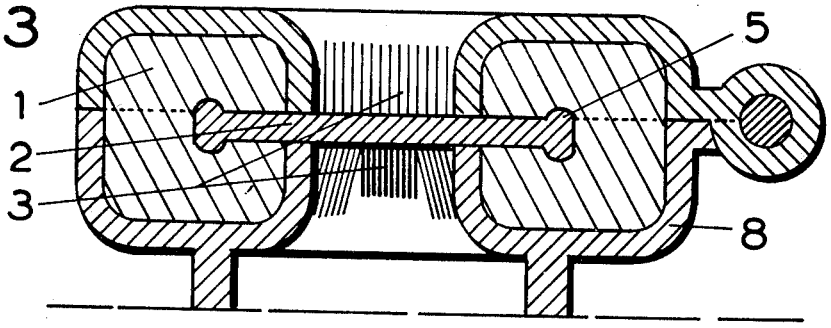
Figure 4:
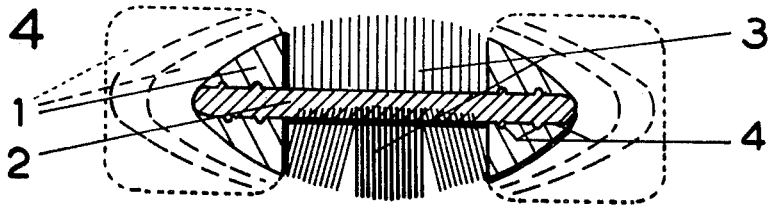
Figure 7:
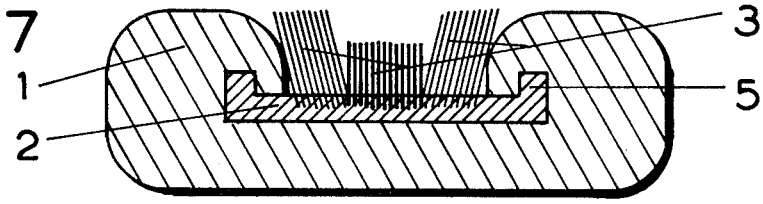
Figure 8:
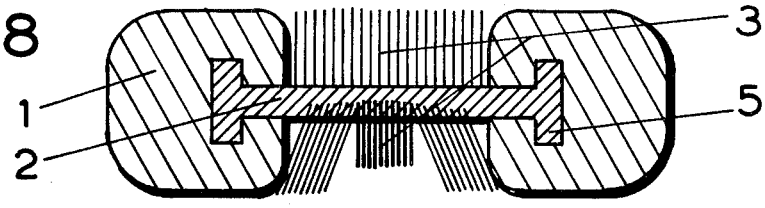
Figure 9:
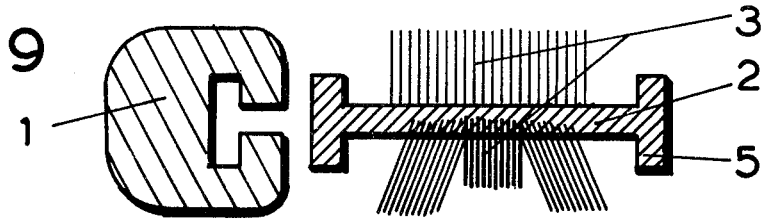
Figure 10:
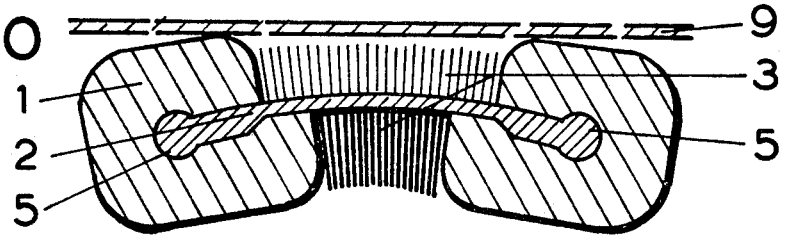
Figure 11:
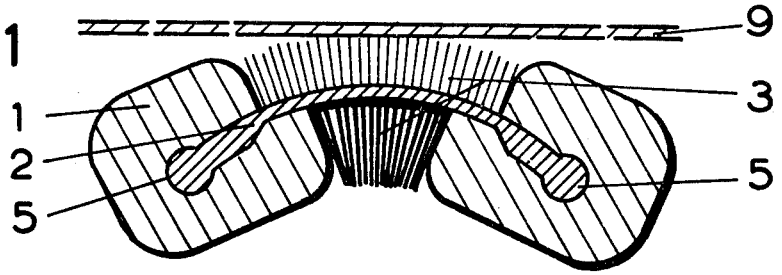
Figure 12:
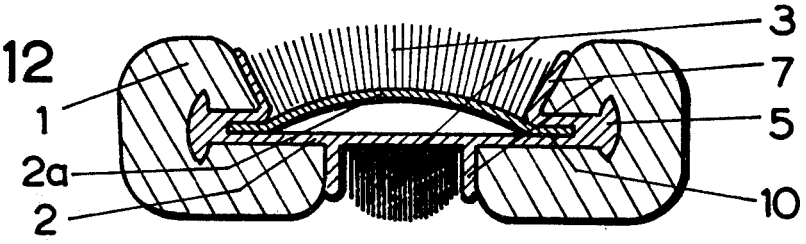
Figure 13:
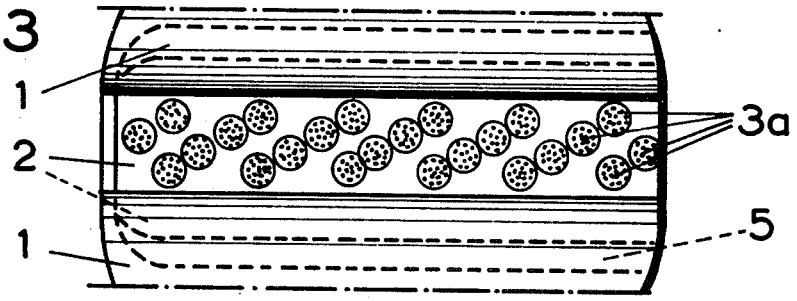
Figure 14:
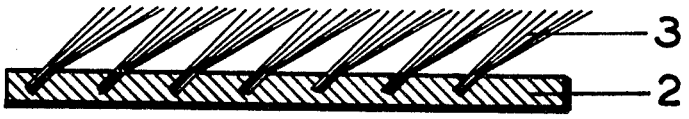
Figure 15:
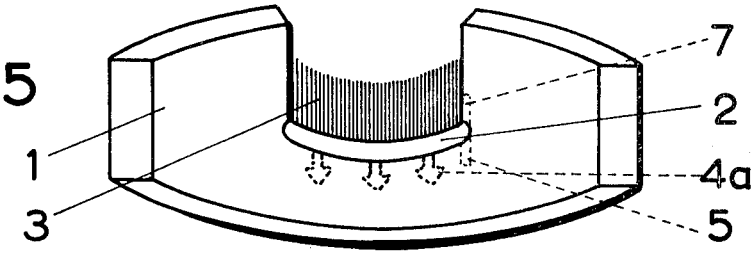
Figure 16:
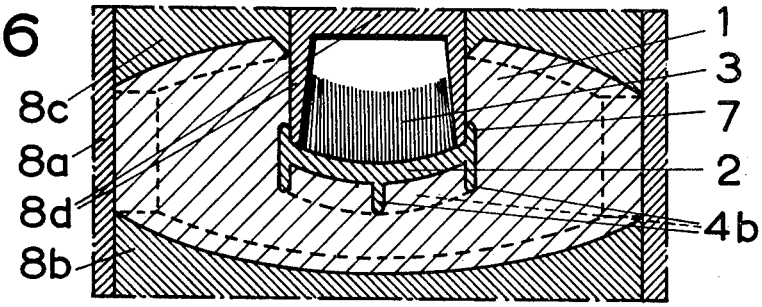
Figure 17:
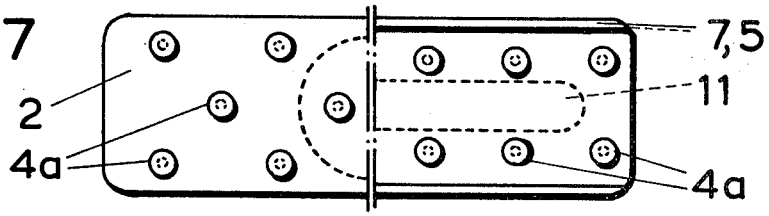

Some examples of the invention are shown in the accompanying drawings and are described below. In the drawings, FIG. 1 is a cross-section through a first embodiment of a cake of soap having bristles provided on one side, FIG. 2 is a diagrammatic cross-section of a second embodiment and its mould, FIG. 3 is an alternative view of FIG. 2 with a double-sided brush, FIG. 4 is an example indicating the way in which the soap is progressively used up, FIG. 5 is an embodiment showing bristles located on the end faces of a cake of soap, FIG. 6 shows two alternative embodiments of FIG. 5, FIG. 7 is an embodiment of a brush with bristles of different sizes provided on one side, FIG. 8 is an alternative embodiment of FIG. 7 with a double-sided brush, FIG. 9 shows parts of FIG. 8 before assembly, FIG. 10 is an alternative embodiment with an elastic brush, FIG. 11 is a view of FIG. 10, but bent into an arcuate shape, FIG. 12 is an embodiment with a brush formed of several parts, FIG. 13 is a fragmentary sectional plan view of an embodiment with a particular grouping of the bristles, FIG. 14 is a longitudinal section through an embodiment of a brush having bristles set diagonally, FIG. 15 is a further embodiment in end view, having a plate provided only on the surface of the soap, FIG. 16 is a cross-sectional view through the embodiment of FIG. 15 during its manufacture, showing a section of the mould, FIG. 17 shows two alternative embodiments of the plate shown in FIG. 15, seen from below, and FIG. 18 also shows two alternative embodiments from below of the plate shown in FIG. 16.

Figure 1:
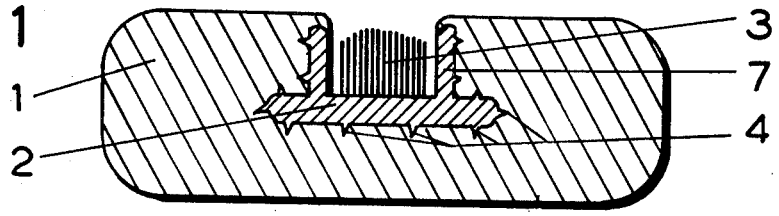

In the cake of soap 1 of FIG. 1 a brush consisting of a plate 2 and bristles 3 anchored thereon is embedded so that during the period of use it is held captive in the cake of soap 1. This is effected by spikes 4, formed on the contact surfaces of the plate 2, which prevent the plate from slipping out of position during use. A protuberance 5 (see FIG. 3 and 7 to 12) located on the edge of the plate 2 serves the same purpose, or apertures 6 in the plate portions (FIGS. 5 and 8) may be provided which apertures are filled by the soap to form a perfect anchorage.

The tips of the bristles, 3, as shown in the drawings in various embodiments, may extend over a flat, curved or hollow surface. This surface may be coplanar with the face of the soap, or may be located to project beyond or to be recessed in the soap. The bristles 3 in FIGS. 1, 2, 6 and 7 may be located only on one side of the plate 2, or oppositely on both sides of the plate. The arrangement of several bristle strips side by side is often preferable, with bristles 3 of varying stiffness (see FIGS. 2 to 4 and 7 to 9).

Figure 5:
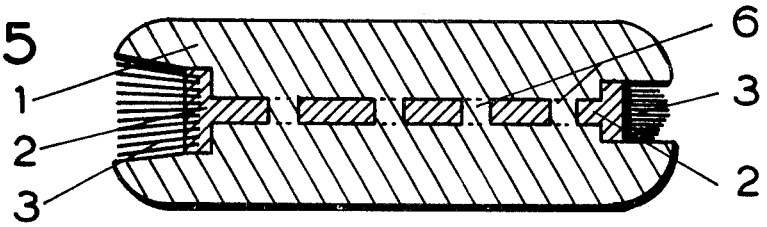
Figure 6:
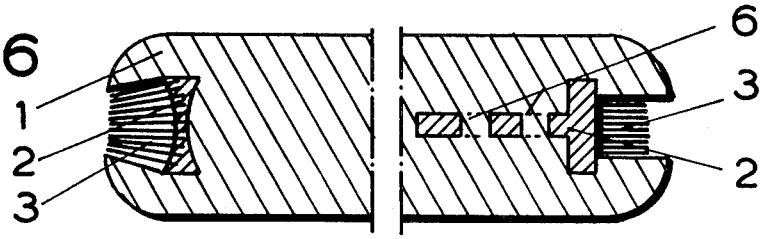

The bristles 3 — located on one side or on both sides of the plate — may project from the flatter surfaces of the cake of soap 1 or, as shown in FIGS. 5 and 6 they may be located on the end face of the soap 1. The brush, 2, 3 may also be arranged diagonally relative to the base surface of the soap 1 and may be longitudinally and/or transversely inclined relative to the surface of the soap. The latter embodiments have the advantage that any water collected in the brush portion will not have any adverse effect on the soap, since it can drain out when the soap is put down, whilst when the brush is embedded with its plate parallel to the soap surface the water may not drain off, but penetrate the seam between soap 1 and plate 2, thus loosening the anchoring of the brush 2, 3. Loosening may also be prevented by the use of webs 7 on both sides of the bristles 3 on plate 2 (see FIGS, 1,2 or 12) and which completely prevent bristle water from penetrating the soap.

Such webs 7 may serve to clamp the brushes 2, 3 to the upper part of a mould 8 (FIG. 2) during the production of the cake of soap; this is particularly useful when, as shown in FIG. 2, brushes are used with bristles 3 mounted on one side only of the plate. When embedding plates 2 provided on both sides with bristles 3 it may, however, suffice for these to be simply placed on the lower part of the mould 8 before injection of the soap.

The brushes 2, 3 can be mass produced so cheaply —possibly as injection mouldings, — that after the soap has been used up, they may be discarded. As indicated in FIG. 4, by suitable configuration of the piece of soap 1 itself and the surface of the bristle tips, almost complete utilization of the soap is ensured.

If, on the other hand, more costly brushes 2, 3 are used for special purposes then the present invention presents the possibility for such brushes to be used repeatedly in several cakes of soap 1. Both the cakes of soap 1 and the plates 2 are formed from sections of profile extrusions which are so formed and dimensioned that they may be slid one into the other as shown in FIGS. 7 and 8, and in FIG. 9 where the parts are dissociated.

A further embodiment is shown in FIGS. 10 and 11. Here the plate 2 is reduced in thickness in its central region or otherwise rendered very flexible. As shown in FIG. 10 it may be slightly pre-curved, so that it bends further when sideways pressure is applied, as shown in FIG. 11. The advantage of this is that a surface 9 which is to be cleaned intensively may be treated either only with the soap (FIG. 10) only with the brush 2, 3 (FIG. 11) or with both simultaneously, for which purpose it is necessary only for the lateral pressure against the piece of soap to be exerted or varied to a greater or lesser extent. Such embodiment is mainly suitable for doctors, hospitals, or in chemical laboratories and the like. It is also suitable for accommodating special cleansing agents in the brush region, possibly in place of the bristles 3, such agents being highly scouring, abrasive material, lamellar pumice stone, or chemically active substances.

In the embodiment shown in FIG. 12 a second plate 2*a* is anchored in grooves 10 in the plate 2, the plate 2*a* being highly elastic and arched. In this embodiment the bristle tips 3 project beyond the plane of the piece of soap 1, so that either brush 2*a*, 3 may be used — without exerting pressure on the soap.

If the brush 2, 3 is to be used as a nail brush, then it is expedient for the rows 3*a* of bristle tufts to be located diagonally to the plate 2, as shown in plan view in FIG. 13. This embodiment ensures that the bristles 3 engage below the finger nails during each brush stroke. This arrangement is preferable to the hitherto usual grouping of the tufts extending parallel with the edge of the plate, since the tendency here is to move the finger-ends along the spaces between the rows of tufts, so that only a few bristles at any one time are able to fulfil their cleaning function. Any brush 2,3 embedded in the cake of soap 1, may be used alone as a separate brush after the soap has been used up. The bristle tufts 3, 3*a* may be mounted in such a manner that, seen in longitudinal section, they are inclined with respect to the plate. This encourages lather production (see FIG. 14).

Figure 18:
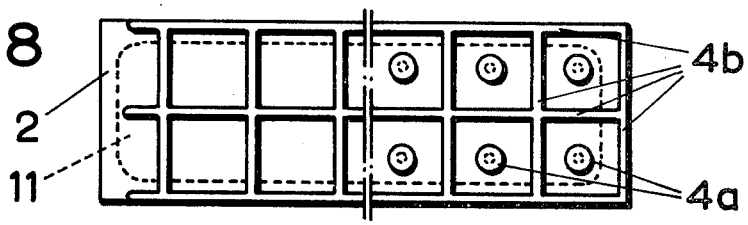

FIG. 15 and 16 show a particularly useful embodiment of a cake of soap, in which only the surface of the plate 2 is provided with bristles 3. Pin-shaped spikes 4 with heads for a are distributed over the underside of the plate 2 and provide a permanent anchoring. Since the soap composition during press-moulding Projecting upwardly and downwardly from each edge of the plate 2, as best shown in FIG. 16, are respective flanges or projections 7, 5 which are at least partially embedded in the cake of soap 1 with the uppermost flanges cooperating with the upwardly opening concave configuration of the plate 2 for preventing errosion of the cake of soap 1 through disintegration by water. Since the soap composition during press-molding in a heated state is still a soft, kneadable composition, it is able to enter undercuts such as beneath the heads 4*a* of the spikes 4. The spikes 4, 4*a* may be replaced by cross-ribs located on the underside of the plate 2, which may also have an undercut cross-section. As shown in FIGS. 16 and 18, the ribs may be combined with longitudinal ribs into honeycombs 4*b*, on the left hand side of FIG. 18. Finally, as shown on the right hand side of FIG. 18, the honeycombs 4*b* may be combined with the pins 4, 4*a*. In all cases the plate 2 is secured in the completed cake of soap against longitudinal displacement and also against being pulled out.

FIG. 16 shows a section of a press tool 8, in which the lower die 8*b* located between vertical guides 8*a* is smooth and integral, whilst the upper die 8*c* contains a separately displaceable press insert 8*d* which abuts against the lateral edges of the plate 2 and presses the latter into the soft soap composition 1.

The plate 2 should not engage very deeply into the lateral solid blocks of the piece of soap 1, but should engage over the protuberances 5 or vertical webs 7 behind the mounted bristles 3, so that during pressing, fine gaps which otherwise would cause a premature softening of the piece of soap in the region of the end face extensions of the plate edges when wetted, are avoided.

Softening of the piece of soap 1 along the edges of the plate 2 during use may also be avoided by making the plate concave at its surface provided with bristles 3; this may be effected by using a concave or a V-shaped form of plate. In a plate 2 so formed (see FIGS. 15 and 16) the residual water accruing during each usage collects at the central region of the plate 2 and in this manner is prevented from penetrating into the edge regions.

An additional protection against premature softening of the soap may also be effected by suspending it when not in use. For this purpose magnetic suspension is preferable in the form of a magnet fixed to a wall and a magnetic disc pressed from the outside into the soap. This embodiment, however, has the disadvantage that the disc is located on the surface of the soap and interfaces with its use.

The present invention presents the possibility of providing the plate 2 with at least one magnetic component which is located in the interior of the soap. The components may be magnetic discs 11 which are smaller than the plate 2, as indicated in various forms, for example, in FIGS. 17 and 18 in broken lines. Such magnetic discs 11 may be connected to the plate 2, e.g. by clamping or may possibly be embedded therein. A further possibility is to make the plate 2 itself wholly or partly from a magnetic material such as a plastics material with admixed iron filings.

The advantages of the invention reside in that at the same time as the soap is active, an extensive cleansing lathering is caused by the brush, whilst the lather is brushed into the hands or arms. The cleansing effect may be increased, reduced or supplemented by additives combined with the brush or by mechanical or chemical means. The soap and brush of the invention is particularly suitable for intensive cleaning of finger nails.

The various forms of the invention, more particularly those of FIGS. 15 to 18 substantially minimize the risk of premature softening of the soap, particularly in the region of the connecting edges to the plate 2, thus preventing crumbling of the piece of soap 1 and loosening of the plate 2.

We claim:

1. An article for cleansing comprising a cake of soap, said cake of soap being defined in part by a top surface and opposite end surfaces, a recess in said cake of soap opening upwardly through said top surface and endwise through said end surfaces, said opening being defined by a bottom surface and opposing spaced inner peripheral surfaces between said top and bottom surfaces and extending between said end surfaces, an imperforate plate in said recess completely covering said bottom surface, means securing said plate to said cake of soap, bristle means carried by said plate and being at least partially disposed within said opening, said plate having means for preventing water from erroding said peripheral surfaces thereby precluding disintegration of said cake of soap, and said errosion preventing means being defined by an upper surface of said plate opening concavely outwardly in a direction toward said top surface.

2. The article as defined in claim 1 including further means for preventing water from erroding said peripheral surfaces, said further errosion preventing means being a pair of flanges carried by said plate, said flanges being directed from said plate upper surface toward said top surface, each flange being contiguous an associated one of said peripheral surfaces, and said flanges extending between said end surfaces whereby water within the confines of said flanges and said plate upper surface can drain endwise through said end surfaces without adversely effecting said bottom and peripheral surfaces.

3. The article as defined in claim 2 wherein said plate includes oppositely directed longitudinal edges embedded in said peripheral surfaces defining said securing means.

4. The article as defined in claim 3 wherein said plate includes a bottom surface from which is directed projections embedded in said cake of soap defining said securing means.

5. The article as defined in claim 4 wherein said plate includes a bottom surface from which is downwardly directed a pair of spaced endwise extending flanges embedded in said cake of soap defining said securing means.

6. The article as defined in claim 5 including enlarged heads carried by at least selected ones of said projections.

7. The article as defined in claim 2 wherein said plate includes a bottom surface from which is directed projections embedded in said cake of soap defining said securing means.

8. The article as defined in claim 2 wherein said plate includes a bottom surface from which is downwardly directed a pair of spaced endwise extending flanges embedded in said cake of soap defining said securing means.

9. The article as defined in claim 1 wherein said plate includes oppositely directed longitudinal edges embedded in said peripheral surfaces defining said securing means.

10. The article as defined in claim 1 wherein said plate includes a bottom surface from which is directed projections embedded in said cake of soap defining said securing means.

11. The article as defined in claim 1 wherein said plate includes a bottom surface from which is downwardly directed a pair of spaced endwise extending flanges embedded in said cake of soap defining said securing means.

12. The article as defined in claim 1 wherein said plate includes a bottom surface from which is downwardly directed a plurality of walls of a checkerboard configuration as viewed in plan embedded in said cake of soap defining said securing means.

13. The article as defined in claim 1 wherein said plate includes a bottom surface from which is directed projections embedded in said cake of soap defining said securing means, and enlarged heads carried by at least selected ones of said projections.

* * * * *